US006186720B1

(12) United States Patent
Chiang

(10) Patent No.: US 6,186,720 B1
(45) Date of Patent: Feb. 13, 2001

(54) STRUCTURE OF A MULTIPLE PUNCH-BIND MACHINE

(76) Inventor: Tung-Lung Chiang, No. 20, Min Sheng Rd., Tou Liu City, Yu Lin Hsien (TW)

( * ) Notice: Under 35 U.S.C. 154(b), the term of this patent shall be extended for 0 days.

(21) Appl. No.: 09/406,123

(22) Filed: Sep. 27, 1999

(51) Int. Cl.[7] ..... B42B 9/00
(52) U.S. Cl. ..... 412/16; 412/9; 412/22; 412/33; 412/40
(58) Field of Search ..... 412/9, 16, 22, 412/33, 40

(56) References Cited

U.S. PATENT DOCUMENTS 5,431,519 * 7/1995 Baumann ..... 412/40

* cited by examiner

*Primary Examiner*—Willmon Fridie, Jr.
*Assistant Examiner*—Mark T. Henderson
(74) *Attorney, Agent, or Firm*—Rosenberg, Klein & Lee

(57) ABSTRACT

A structure of a multiple punch-bind machine includes a cutter set, linking plate, wire binding device and plastic ring binding device, and which are mounted on a base equipped with arm, the arm has more than a cutter set, one of which is linked to the arm and the rest cutter sets are linked with the linking plate and with the wire binding device or the plastic ring binding device hence punch holes in a different sizes, shapes, distance for binding.

7 Claims, 7 Drawing Sheets

STRUCTURE OF A MULTIPLE PUNCH-BIND MACHINE

BACKGROUND OF THE INVENTION

1. Field of the Invention

This invention relates to a structure of a multiple punch-bind machine and more particularly to punch holes in different sizes, shapes, and distances for binding plastic and wire bindings.

2. Prior Art

The conventional punch-bind machines are mostly in two different categories, which are single purpose of punching and binding machine. Two devices will be needed if both jobs have to be done which is not cost effectiveness both in time and labor consume.

SUMMARY OF THE INVENTION

It is the primary object of the present invention to provide a structure of a multiple punch-bind machine which combines the punching and the binding device together, thus save time and labor.

It is another object of the present invention to provide a structure of a multiple punch-bind machine which is easy to operate.

Figure 1:
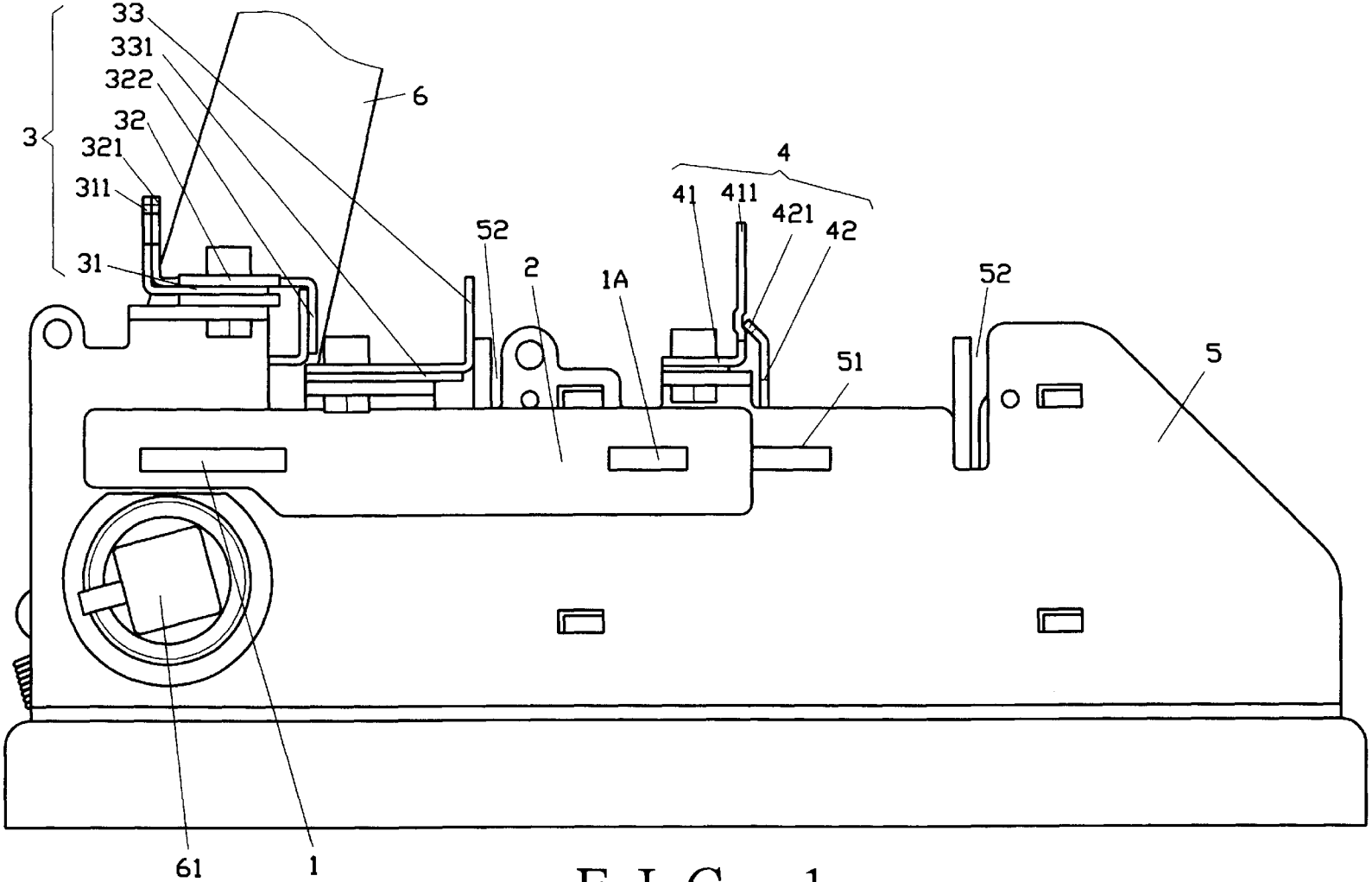
FIG. 1 is a side view of the present invention.
Figure 2:
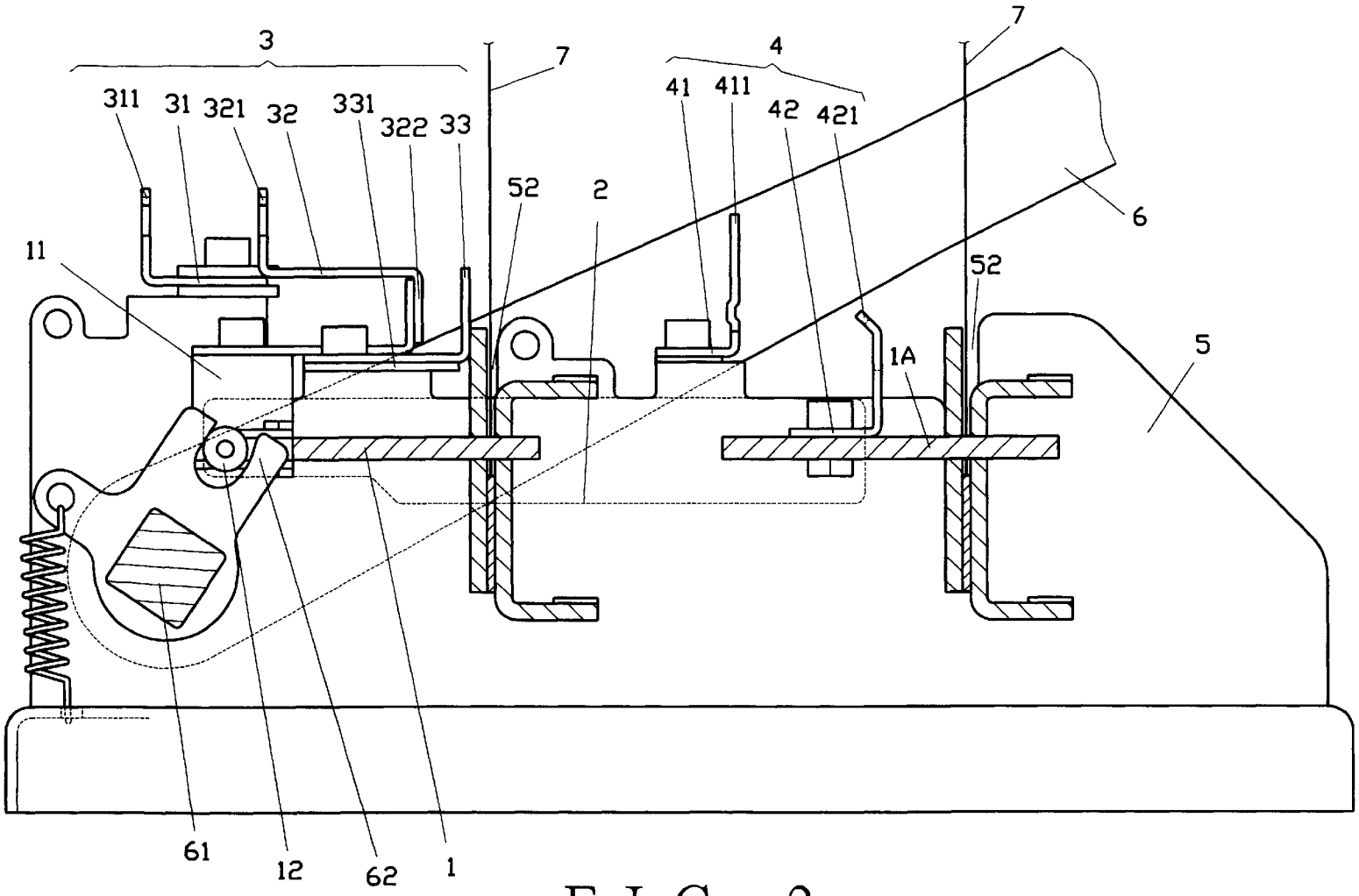
FIG. 2 is a side view similar to FIG. 1, showing punching operation.

DETAILED DESCIRPTION OF THE PREFERRED EMBODIMENT:

The multiple punch-bind machine of the present invention, as shown in FIGS. 1 and 2, is generally composed of a cutter set 1 and 1A, a linking plate 2, a wire binding device 3, a plastic ring binding device 4, a base 5 and an arm 6.

The cutter sets 1 and 1A are mounted on the base 5 with the front ends of the two cutter sets 1 and 1A extending outward from a rail 51 of the base 5 and connected to the linking plate 2 to link the two cutter sets 1 and 1A to operate simultaneously, a slot 52 for paper to slide therein is formed on the front end of the base 5 close to the sharp points of the cutter sets 1 and 1A, the front end of a side board 11 of the cutter set 1 is secured with a guide wheel 12 which is linked by a linkage 61 and a U fork 62 of the arm 6.

The wire binding device 3 includes a fixed hook 31, a slidable hook 32 and a fixture 33. Both of the fixed hook 31 and the slidable hook 32 are composed of hook bodies 311 and 321. The slidable hook 32 further comprises a vertical press 322. The fixture 33 has a magnet 331 at the bottom portion thereof The slidable hook 32 is linked to the cutter set 1.

The plastic ring binder 4 includes a fixed fork 41 having fork strips 411 and a sidable hook 42 having a hook body 421. The slidable hook 42 is linked to the cutter set 1.

In practice, insert paper 7 into the paper slot 52, as shown in FIG. 2, press the arm 6 which lnks to the two cutter sets 1 and 1A to punch the paper at the same time. It usually uses only one cutter set 1 or IA, thus paper will only be placed in one slot 52, however, if it is necessary to punch more than one set of hole, this device is useful.

The binding is in two separate methods, one in wire binding and the other in plastic ring binding, as shown in FIGS. 3, 4, 5 and 6, insert an original wire type 8 through the holes of the paper and secured on the fixture 33 by the magnet 331, press the arm 6 to bring the vertical press 322 down and pressing deform the wire 8, thus form a circle to hold the paper, to disassemble the wire 8, place a wire 8A already in a binding configuration back to the fixed hook 31 and the slidable hook 32 and press the arm 6, the hook body of the fixed hook 31 and the sidable hook 32 will force the circle formed by the wire 8A to separate, thus, the wire 8A is detachable from the paper.

Figure 3:
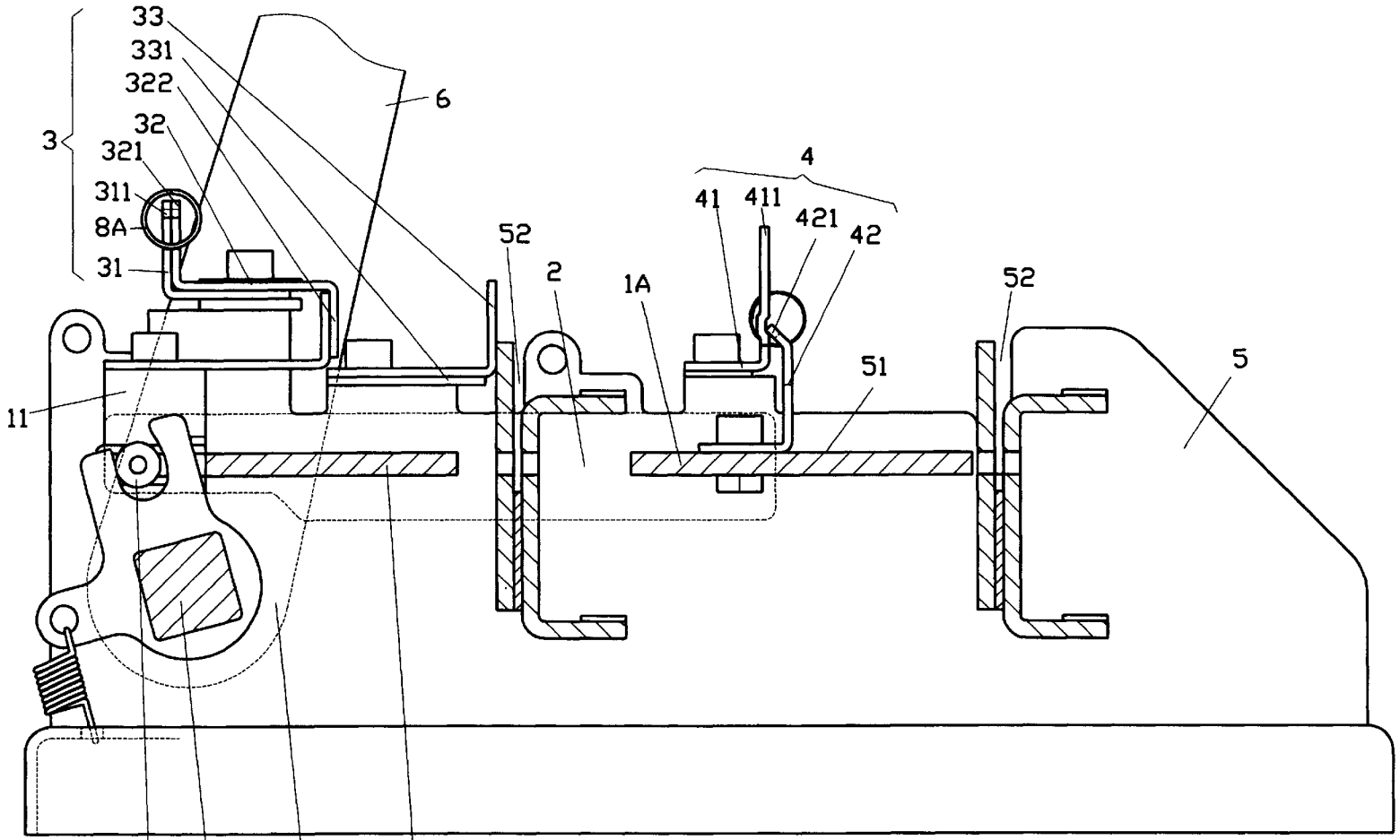
FIG. 3 is a side view similar to FIG. 1, showing an operation of plastic ring binding process.
Figure 4:
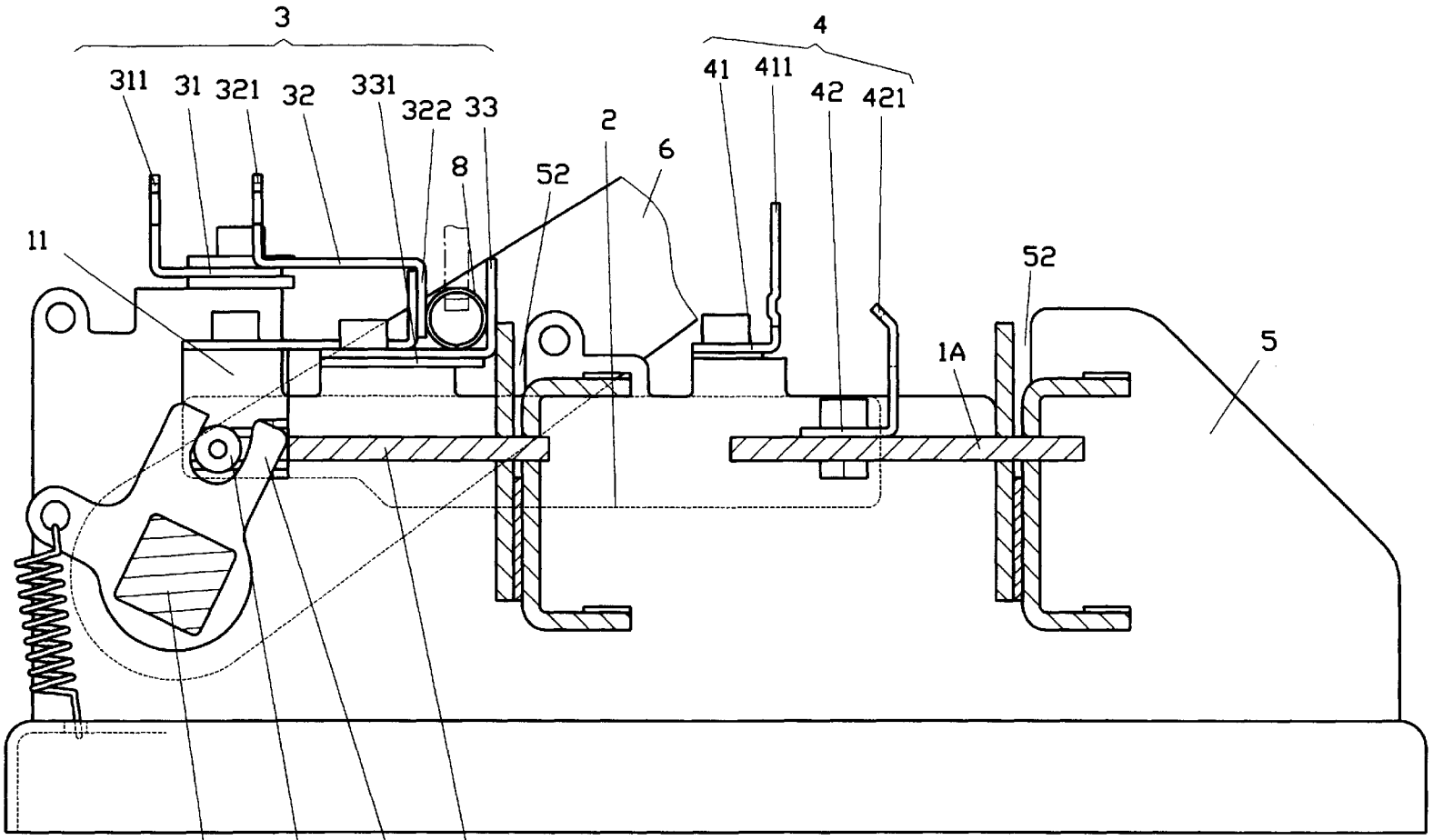
FIG. 4 is another side view similar to FIG. 1, showing operation of wire binding process.
Figure 5:
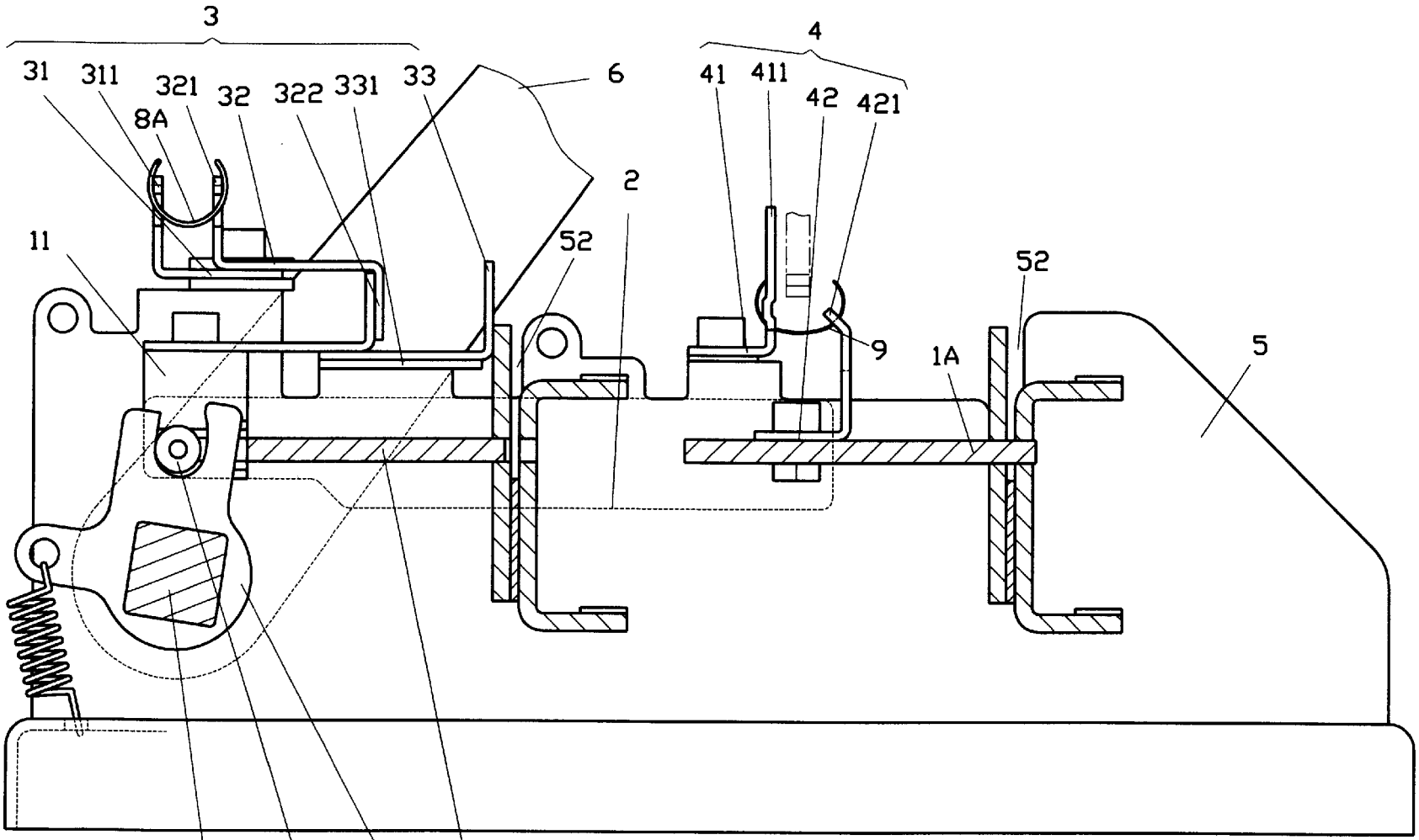
FIG. 5 is a side view similar to FIG. 1, showing the plastic ring and the wire are in open status.
Figure 6:
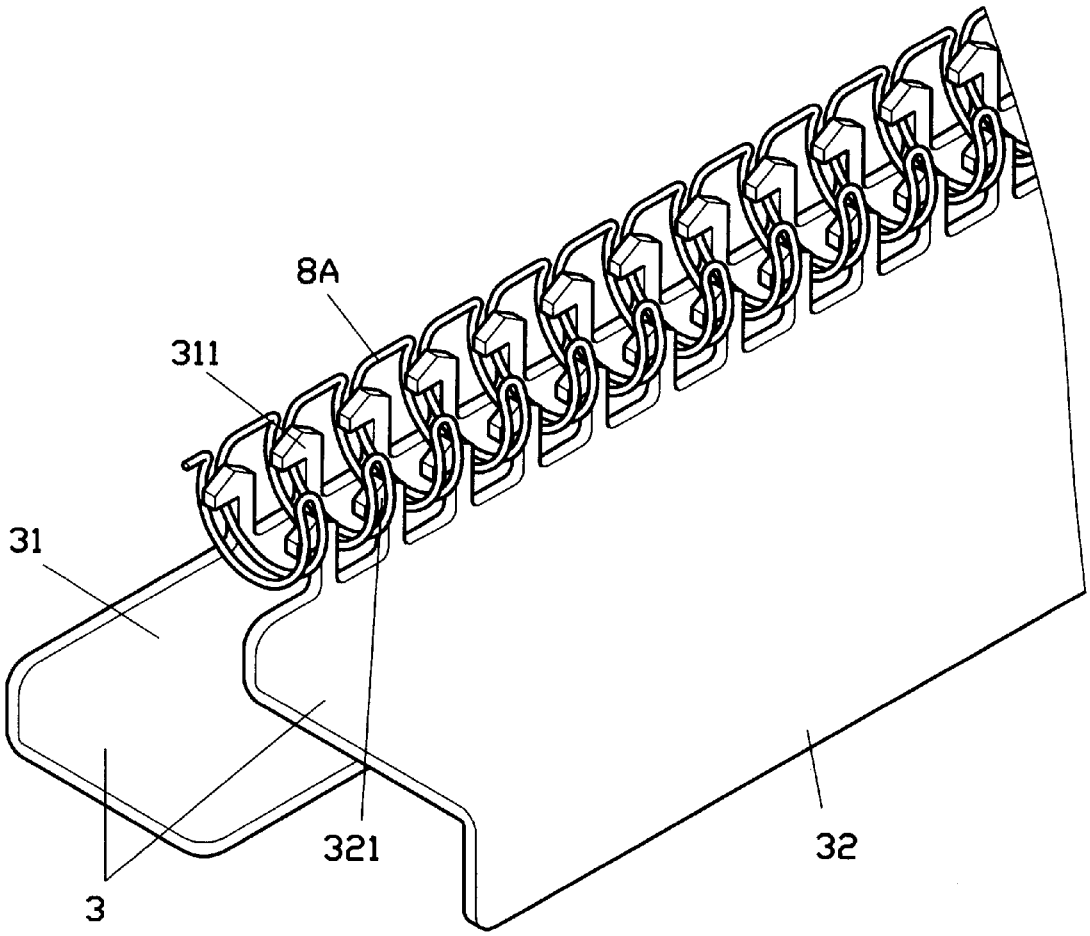
FIG. 6 is an enlarged view of the wire binding device of the present invention.
Figure 7:
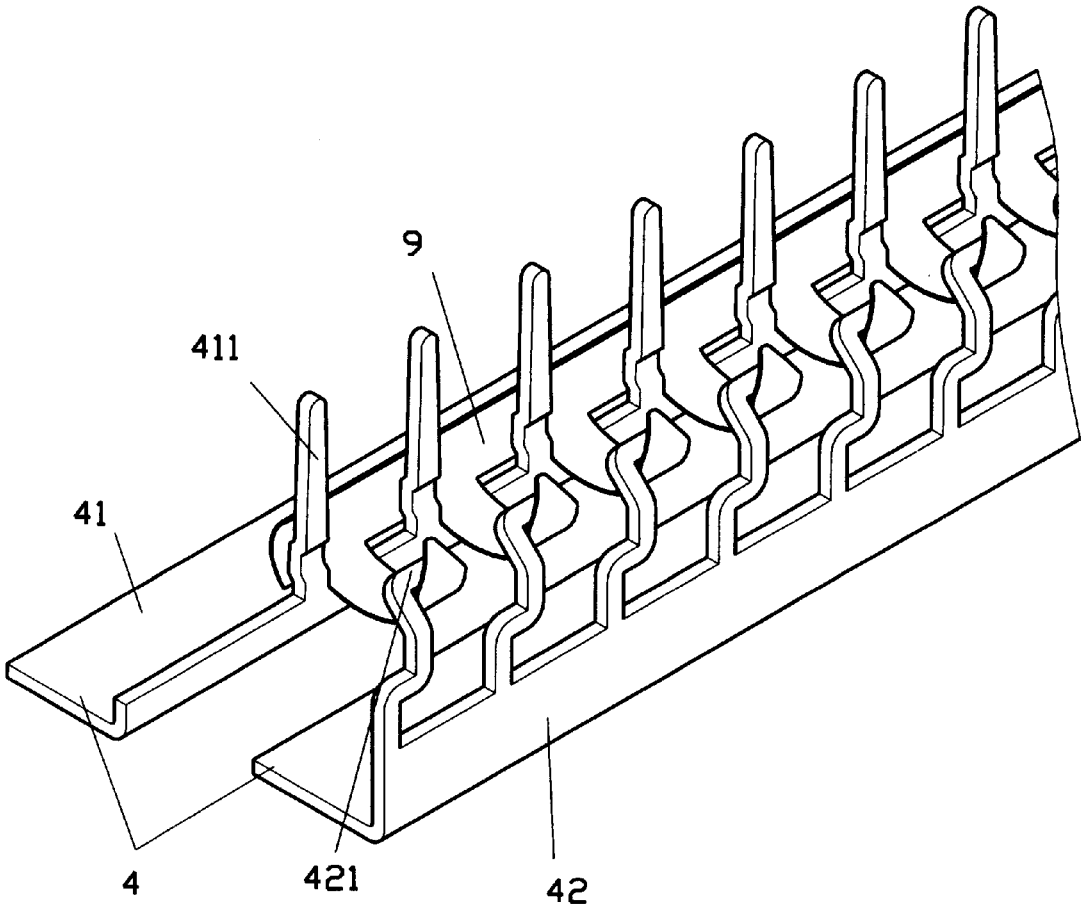
FIG. 7 is an enlarged view of the plastic ring binding device of the present invention.

To do the plastic ring binding , as shown in FIGS. 3, 5 and 7 , place the plastic strip 9 on the fixed fork 41 and the slidale hook 42, press the arm 6, the fork strips 411 of the fixed hook 41 and the hook body 421 of the slidable hook 42 will force the plastic strip 9 separate, thus the strips 9 may be inserted through the hole of the paper.

Moreover, the multiple punch-bind machine of the present vention can be applied for 3 cutter sets and more with linking plate between every two cutter sets.

I claim:

1. An apparatus for punching and binding sheet material comprising:

(a) a base;

(b) an actuation arm displaceably coupled to said base;

(c) a wire binding device coupled to said base;

(d) a plastic ring binding device coupled to said base; and, (e) at least first and second cutter sets coupled to said base and linked one to the other by a linking plate, at least said first cutter set being operably linked to said actuation arm for actuation responsive thereto, each of said first and second cutter sets being operably linked to one of said wire and plastic ring binding devices.

2. The apparatus as recited in claim 1 wherein said wire binding device includes a fixed hook, a fixture, and a slidable hook displaceably coupled therebetween, each of said fixed and slidable hooks having a hook body portion formed thereon.

3. The apparatus as recited in claim 1 wherein said plastic ring binding device includes a fixed hook and a slidable hook displaceably coupled thereto, said fixed hook having formed thereon a fixed fork portion, said slidable hook having formed thereon a hook body portion.

4. The apparatus as recited in claim 2 wherein said slidable hook has formed thereon a press portion.

5. The apparatus as recited in claim 4 wherein said slidable hook is operably linked to said first cutter set.

6. The apparatus as recited in claim 5 wherein said wire binding device further includes a magnet coupled to a bottom portion of said fixture.

7. The apparatus as recited in claim 3 wherein said slidable hook is operably linked to said second cutter set.

* * * * *